US006286683B1

(12) United States Patent
Hunt et al.

(10) Patent No.: US 6,286,683 B1
(45) **Date of Patent: *Sep. 11, 2001**

(54) MULTIPLE-PIECE CORNER POST

(75) Inventors: John F. Hunt, Madison; Yanping Qiu, Middleton, both of WI (US)

(73) Assignees: The United States of America as represented by the Secretary of Argriculture, Washington, DC (US); Sonoco Development, Inc., Hartsville, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,584

(22) Filed: Aug. 27, 1999

(51) Int. Cl.[7] ..... B65D 81/127
(52) U.S. Cl. ..... 206/586; 206/320
(58) Field of Search ..... 206/453, 522, 206/586; 248/345.1; 428/166

(56) References Cited

U.S. PATENT DOCUMENTS

| | | | | |
|---|---|---|---|---|
| 2,068,771 | | 1/1937 | Sherman . | |
| 2,556,529 | * | 6/1951 | Farrell | 206/453 |
| 2,858,037 | | 10/1958 | Rose . | |
| 2,950,038 | | 8/1960 | Rupp . | |
| 3,072,313 | | 1/1963 | Svendsen . | |
| 3,200,547 | | 8/1965 | Johnson . | |
| 3,315,867 | * | 4/1967 | Seltman | 206/586 |
| 3,416,652 | * | 12/1968 | Alamasy | 206/453 |
| 3,433,354 | | 3/1969 | Liebel . | |
| 3,734,389 | | 5/1973 | Brown . | |
| 3,929,536 | * | 12/1975 | Maughan | 206/586 |
| 3,955,677 | * | 5/1976 | Collingwood | 206/453 |
| 3,957,196 | | 5/1976 | Kellerman . | |
| 3,973,720 | | 8/1976 | Schmid . | |
| 3,982,682 | | 9/1976 | Fremion . | |
| 4,012,878 | * | 3/1977 | Ellingson | 248/345.1 |
| 4,027,817 | | 6/1977 | Fremion . | |
| 4,292,901 | | 10/1981 | Cox . | |
| 4,317,517 | * | 3/1982 | Tisdale | 206/586 |
| 4,482,054 | | 11/1984 | Gardner . | |
| 4,483,444 | | 11/1984 | Gardner . | |
| 4,595,137 | | 6/1986 | Kupersmit . | |
| 4,714,163 | | 12/1987 | Reeves . | |
| 4,811,840 | | 3/1989 | Muyskens . | |
| 4,865,201 | | 9/1989 | Liebell . | |
| 4,877,673 | | 10/1989 | Eckel . | |
| 4,898,279 | | 2/1990 | Linnemann . | |
| 4,976,374 | | 12/1990 | Macaluso . | |
| 5,115,917 | | 5/1992 | Schragel . | |
| 5,181,611 | | 1/1993 | Liebel . | |
| 5,184,727 | * | 2/1993 | Dickie et al. | 206/522 |
| 5,267,651 | | 12/1993 | Hughes . | |
| 5,294,044 | | 3/1994 | Clark . | |
| 5,538,178 | | 7/1996 | Zink . | |
| 5,593,039 | | 1/1997 | Ortlieb . | |
| 5,813,537 | | 9/1998 | DeReu . | |
| 5,853,857 | * | 12/1998 | Manmood et al. | 428/166 |
| 5,862,914 | * | 1/1999 | Farison et al. | 206/522 |
| 5,918,800 | * | 7/1999 | Goshorn et al. | 206/586 |

FOREIGN PATENT DOCUMENTS

| | | | | |
|---|---|---|---|---|
| 4-294763 | * | 10/1992 | (JP) | 206/586 |
| 5-170264 | * | 7/1993 | (JP) | 206/586 |

* cited by examiner

*Primary Examiner*—Jim Foster
(74) *Attorney, Agent, or Firm*—Bullwinkle Partners, Ltd.

(57) ABSTRACT

A multiple-piece corner post used for cushioning and supporting large appliances is provided. The corner post is made from two or more structural members joined together. The multiple structural members are shaped into the desired shapes and then joined together near the ends to form a generally "L" shaped corner post. Similarly shaped structural members may be nested to save space during shipping prior to assembly.

12 Claims, 4 Drawing Sheets

FIG. 5
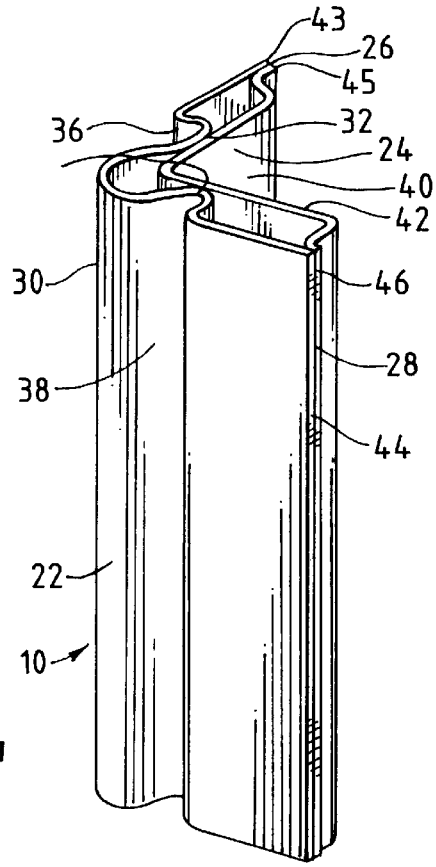
FIG. 6A
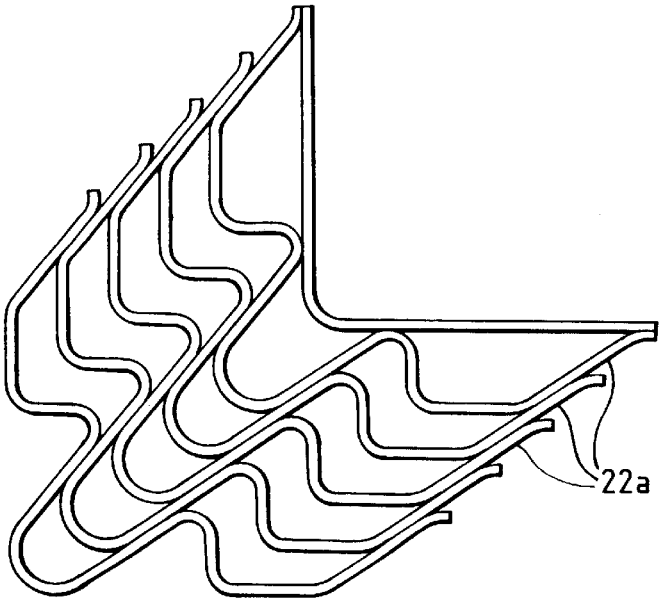
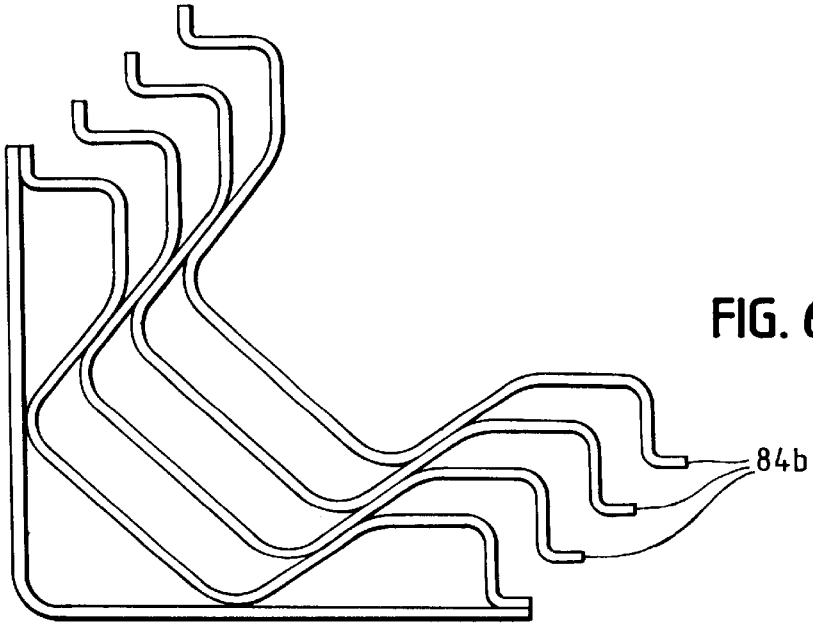
FIG. 6B

MULTIPLE-PIECE CORNER POST

U.S. GOVERNMENT RIGHTS

As a result of joint research, the U.S. Government is a co-owner of this invention.

BACKGROUND

1. Field of the Invention

This patent relates to packaging for large and sometimes heavy products such as washers, dryers and refrigerators. More particularly, this patent relates to a multiple-piece corner post that can be made from more than one type of paper and can be varied as to paper direction, and where the pieces can be nested to take up less space during shipping to the assembly site.

2. Description of the Related Art

Corner posts consisting essentially of shaped paper tubes are used to support and cushion the corners of large, heavy appliances (such as washers, dryers, refrigerators, dishwashers and stoves) during storage and transport. Conventional corner posts are made of a single sheet of paper wound into a convolute (coiled) tube. Adhesive is often used to bond the paper layers. Before the adhesive dries, the tube is shaped into the desired shape, typically one with a modified "L" shaped cross section to fit snugly about the corner of an appliance or other product.

Among the disadvantages of conventional corner posts are: (1) only one type of paper can be used for each tube, since the tube is formed from a single sheet of paper rolled into a tube shape, (2) only one paper direction can be achieved using conventional winding methods, and (3) the finished hollow tubes take up considerable space during shipment to the site where they are to be used.

The present invention overcomes these and other disadvantages by providing an improved corner post comprising multiple pieces joined to form a tube. The improved multi-piece corner post can be made from more than one type of paper and can be varied as to paper direction. During shipment to the assembly site, individual pieces can be nested together to take up less space. Before use, the pieces are joined together at the ends to form a unitary structure.

Thus it is an object of the present invention to provide a corner post made from two or more separate laminated paper structural shapes joined together.

A further object is to provide a corner post made from multiple laminated members such that like members can be nested together during shipment prior to assembly.

A still further object is to provide a multi-piece corner post in which the adhesive used between the paper layers of one piece can differ from the adhesive used between the paper layers of the other piece or pieces.

Yet another object is to provide a multi-piece corner post in which the type of paper and paper orientation can be varied between the separate pieces to optimize both structural and economic efficiencies.

Still another object is to provide a multi-piece corner post capable of being shaped into complex shapes not possible with conventional single piece corner posts.

Further and additional objects will appear from the description, accompanying drawings, and appended claims.

SUMMARY OF THE INVENTION

The present invention is an elongated structural paper tube (corner post) used for lateral protecting and cushioning of products and providing packaging support along the axial direction of the tube. The invention comprises two or more structural members joined together. The multiple structural members are shaped into desired shapes and then joined together at the outer edges to form a generally "L" shaped corner post. Similarly shaped structural members may be nested to save space during shipping prior to assembly.

In one embodiment, each end of the inner wall or member abuts a rib formed by the corresponding end of the outer member or wall. The ribs at either end of the outer member may increase the stiffness of the overall corner post by providing a surface against which the ends of the inner member abut.

THE DRAWINGS

FIG. 5 is a perspective view of the corner post of FIG. 2 shown without the product or the package;

Figure 2:
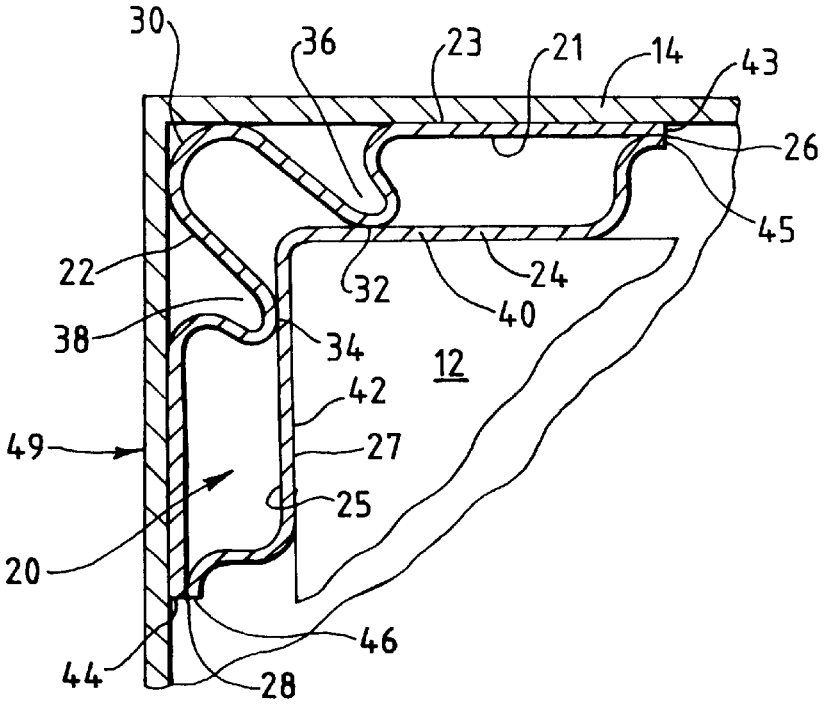
FIG. 2 is a cross-sectional view of the corner post of the present invention illustrating its position relative to a product within a package.
Figure 4:
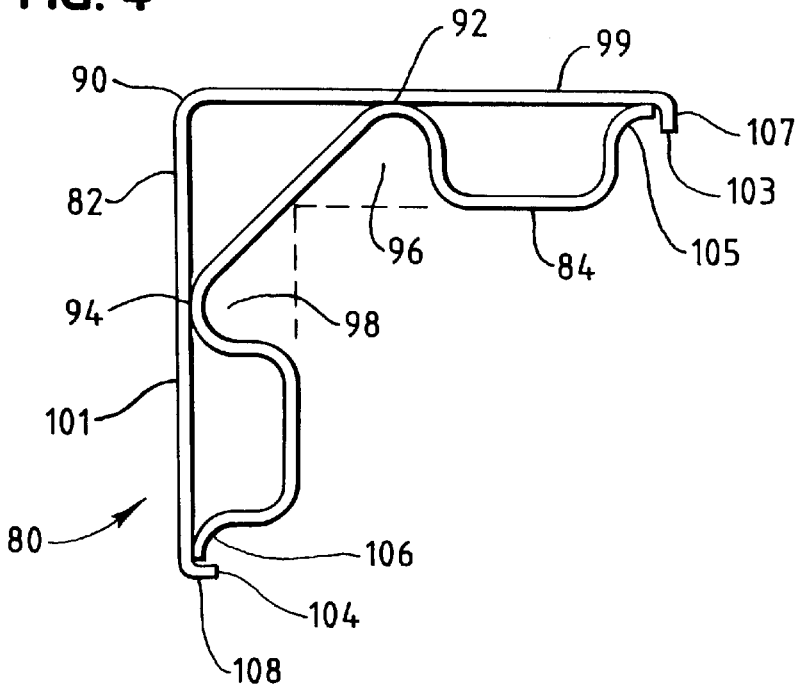
FIG. 4 is a top plan view of a third embodiment of the corner post of the present invention.
Figure 7:
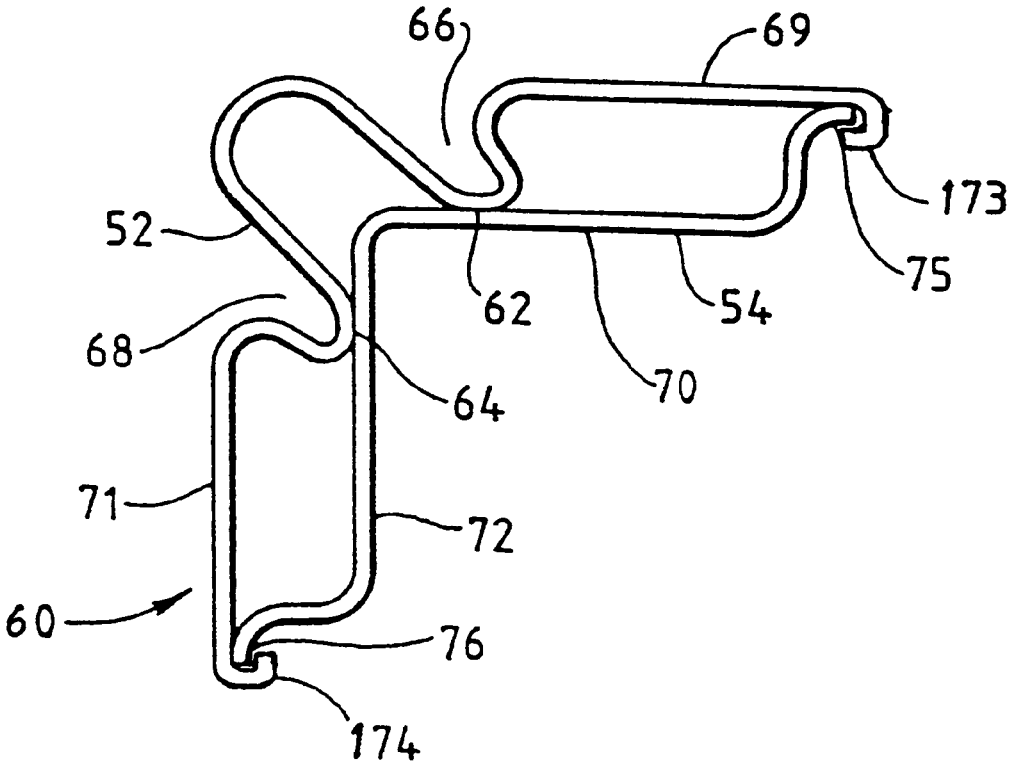

FIG. 6*a* is a top plan view of an embodiment similar to the embodiment of FIG. 2 but modified so that multiple outer members may be nested to occupy about half the space occupied by unnested outer members;

FIG. 6*b* is a top plan view of an embodiment similar to the embodiment of FIG. 4 but modified so that multiple inner members may be nested to occupy about half the space occupied by unnested inner members:

FIG. 7 is a top plan view of a fourth embodiment of the corner post of the present invention.

DETAILED DESCRIPTION OF THE INVENTION

Figure 1:
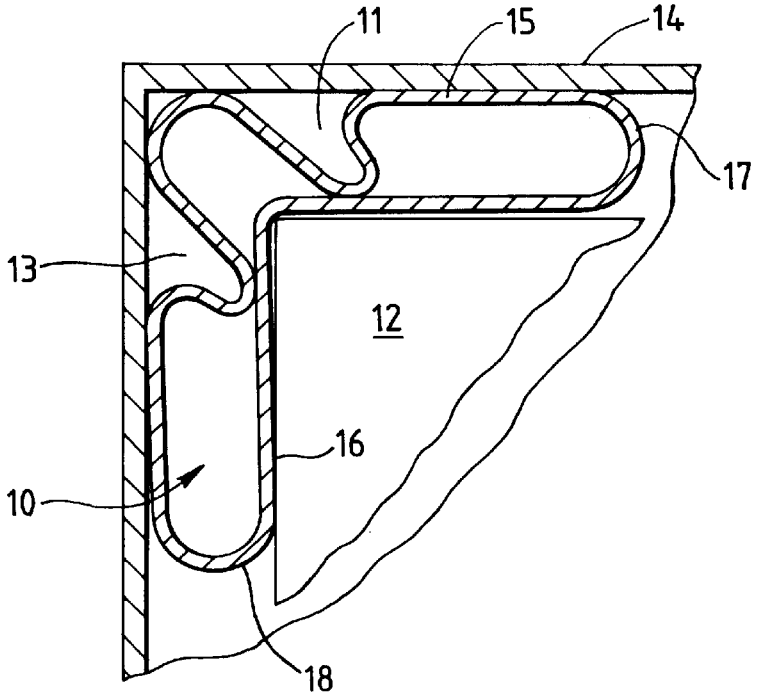
FIG. 1 (PRIOR ART)
FIG. 1 is a cross sectional view of a conventional corner post illustrating its position relative to a product within a package.

Turning to the drawings, there is shown in FIG. 1 a cross-sectional view of a conventional corner post 10 illustrating its position relative to a product 12 and a package 14. The product 12 typically is a large, heavy appliance such as a washer, dryer or refrigerator. The corner post 10 is interposed between the product 12 and the package 14 in confining engagement therewith to provide for lateral cushioning of the product 12 and axial support of the product packaging. The corner post 10 normally extends upward from a base pad (not shown) located beneath the product 12 to a top cap or lid (not shown).

The corner post 10 of FIG. 1 comprises an outer wall 15, an inner wall 16, and two rounded edges 17, 18, all formed from a single tube. The outer wall may, as in this case, include beads, indentations or grooves 11, 13 for added support. Alternatively, the inner wall or both walls may include beads. The rounded edges and beads increase the overall strength of the corner post 10.

Conventional corner posts such as that shown in FIG. 1 are constructed of a single sheet of paper by winding the paper into a convoluted tube. The tube is subsequently reshaped into a modified "L" shape to facilitate positioning between the product and the package at the product corners. The "L" shape also enhances structural strength both axially (vertically) and laterally. Adhesive is used to bond consecutive layers of paper during winding. The reshaping of the tube into the desired final shape occurs before the adhesive begins to solidify.

Because they are made of a single paper tube, conventional corner posts are limited to a single type of paper, a single predominant paper direction, and a single type of adhesive for bonding consecutive paper layers. A further limitation of conventional single piece corner posts is that the number of paper layers between the outside and inside walls can be varied a maximum of only one layer.

Economic and structural improvements to conventional single piece corner posts are limited to changing the lone paper type, changing the predominant paper direction, changing the lone type of adhesive used, changing the overall number of paper layers, and changing the overall shape of the tube. A further disadvantage is that these tubes, which have a significant amount of hollow space inside, must be shipped as a complete structure, thereby limiting the number of tubes that can be shipped per volume of shipping space.

We have overcome these disadvantages by developing a corner post which is constructed of two or more pieces or members. FIG. 2 shows one embodiment of our invention, a two-piece corner post 20 shown as it might be used to cushion and support a product 12 within a package 14. In the illustrated embodiment, the corner post 20 comprises an elongate vertical outer piece or member 22 and an elongate vertical inner piece or member 24 joined together. The outer member 22 and the inner member 24 are substantially coextensive, that is, the two members have substantially the same spatial boundaries.

The corner post 20 has two outer edges 26, 28 located away from the outer corner 30 of the post 20. One outer edge 26 is defined by first adjacent ends 43, 45 of the outer and inner members 22, 24. The other outer edge 28 is defined by second adjacent ends 44, 46 of the outer and inner members 22, 24. The adjacent ends of the outer member 22 and the inner member 24 may be joined by adhesive or any other suitable means.

In the embodiment shown in FIG. 2, the outer member 22 has formed therein inwardly directed beads or indentations 36, 38 which increase the strength of the corner post. These beads contact the inner member 24 to provide added strength to the structure.

The inner and outer members 22, 24 may be made from different types of laminated paper or may have a different number of paper layers. Different adhesives may be used to laminate each member. It is also possible with the multiple piece corner post 20 to have the paper layers of the respective members 22, 24 oriented in different directions. Thus the performance characteristics and strength:cost ratio of our new corner post 20 can be optimized by changing the type of paper, number of layers, type of adhesive, and winding direction used for each member.

FIG. 5 is a perspective view of the corner post of FIG. 2 shown without the product or the package. The corner post 10 has a vertical dimension determined by the distance between the base pad (not shown) and the package top (not shown), or roughly slightly greater than the height of the product to be packaged. FIG. 5 clearly shows the beads or indentations 36, 38 formed in the outer member 22.

Figure 3:
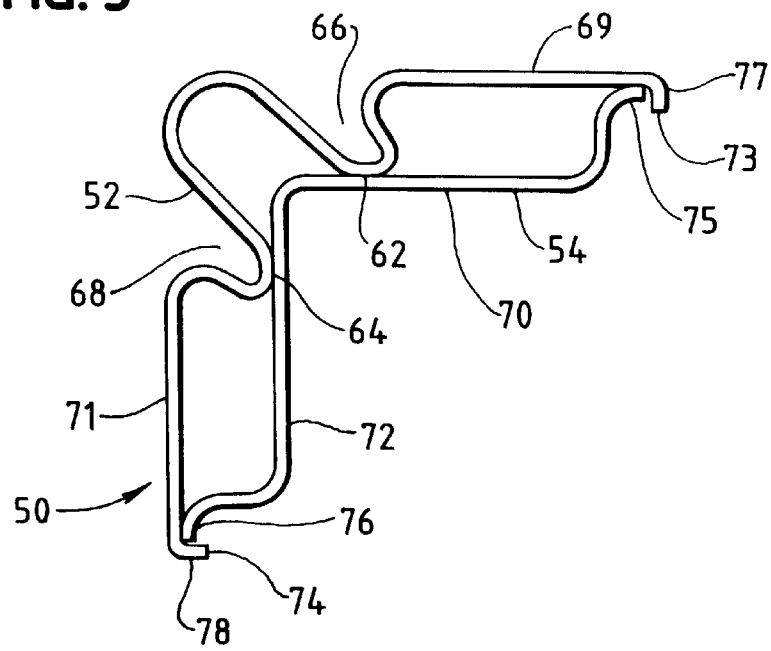
FIG. 3 is a top plan view of a second embodiment of the corner post of the present invention.

FIG. 3 is a top plan view of a second embodiment 50 of the corner post of the present invention, shown without the product and outer package. Extending longitudinally along the entire length of the outer member 52 are beads 66, 68. These beads contact the inner member 54. The ends 73, 74 of the outer member 52 are bent inwardly at approximately a right angle to form ribs. The corresponding ends 75, 76 of the inner member 54 fit snugly against the inside of the ribs 73, 74 to form a stable structure.

With respect to this second embodiment it is preferred that the ends of the inner and outer members be fastened with adhesive or other fastening means, although it is anticipated that in certain configurations, no additional fastening means will be required. For example, in one anticipated configuration 60 FIG. 7, each end 173, 174 of the outer member is bent inwardly at approximately a right angle and then bent a second time also at approximately a right angle to form a U-shaped end defining a slot therein. Each end of the inner member would then fit snugly inside the corresponding slot, without the need for additional fastening means.

FIG. 4 is a top plan view of a third embodiment of the corner post of the present invention. As in the embodiments in FIGS. 2 and 3, the corner post 80 is formed from an outer member 82 and an inner member 84 joined together. As in FIG. 3, the ends 103, 104 of the outer member 82 form ribs against which the ends 105, 106 of the inner member 84 abut. Unlike the previous two embodiments, the outer member 82 in FIG. 4 does not incorporate strengthening beads. Instead, outer member 82 comprises two generally flat wall sections 99, 101 that meet along an outer corner 90. The inner member 84 comprises two concave beads 96, 98 that contact the outer member 82.

Including the ends, there are four contact areas in each of the corner post embodiments shown in FIGS. 2–4. That is, the outer and inner members contact each other along four vertical areas. Other configurations are anticipated which would result in more contact areas, such as configurations having more than two beads. Still other configurations are anticipated that would have fewer than four contact areas.

As noted earlier, one advantage of the present invention is that in certain embodiments, the corner post may be shipped prior to assembly by nesting like-shaped pieces together. This practice would conserve space and allow for an increased number of corner posts shipped per unit volume of shipping space compared with current practice using conventional one-piece corner posts.

Nesting of like-shaped pieces is illustrated in FIGS. 6*a* and 6*b* using modified versions of the corner posts shown in FIGS. 2 and 4 respectively. In FIG. 6*a*, the outer members 22*a* are nested together to occupy only about half the space of comparable unnested pieces. In FIG. 6*b*, the inner members 84*b* are nested together occupy only about half the space of comparable unnested pieces.

Although the embodiments heretofore described and illustrated are all generally L-shaped corner posts, it will be appreciated that other multi-piece cushioning and support structural shapes are anticipated. For example, a multi-piece generally I-shaped side post may be used to cushion and support the sides of large appliances.

Thus we have provided a multi-piece structural support that can be used to cushion and support large products such as appliances during storage and transport. The appliance is first placed on and fastened to a pallet. The structural supports are placed at the corners and/or sides of the appliance to protect the appliance from scratching and denting during shipping and handling. A protective sleeve made of paperboard or corrugated board may be placed around the structural supports to form the four sidewalls of a container. A paperboard or corrugated top may be used as a container lid.

Other modifications and alternative embodiments of the invention are contemplated which do not depart from the spirit and scope of the invention as defined by the foregoing teachings and appended claims. It is intended that the claims cover all such modifications that fall within their scope.

We claim as our invention:

1. An elongate tubular corner post for use in the packaging of a product, said corner post having a generally L-shaped cross-section, a top end, a bottom end, and opposite edges extending axially from the top end to the bottom end, said corner post comprising:

an elongate outer member made from layers of substantially flat paper laminated and shaped into a desired shape, said outer member extending axially along the side of the tubular corner post away from the product, said outer member having a vertex and opposite vertical ends; and a separate elongate inner member made from layers of substantially flat paper laminated and shaped into a desired shape, said inner member extending axially along the side of the tubular corner post toward the product, said inner member being substantially coextensive with and spaced from the outer member to define at least one hollow space therebetween, said inner member having opposite vertical ends, each inner member vertical end being turned toward the outer member at approximately a right angle and extending the distance between the outer and inner members such that the inner member is contiguous with the outer member, then turned away from the outer member vertex at approximately a right angle;

wherein the corresponding ends of the outer and inner members are contiguous, straight, extend away from the outer member vertex, and are joined together along the opposite edges of the corner post to form a seam.

2. The corner post of claim 1 wherein the members are joined to each other with adhesive.

3. The corner post of claim 1 further comprising at least one bead running the length of the corner post and formed solely by the outer member.

4. The corner post of claim 1 further comprising at least one bead running the length of the corner post and formed solely by the inner member for enhancing the axial strength of the corner post.

5. The corner post of claim 1 wherein like members are configured to nest within one another.

6. An elongate tubular corner post for use in the packaging of a product, said corner post having a generally L-shaped cross-section, a top end, a bottom end, and opposite edges extending axially from the top end to the bottom end, said corner post comprising:

an elongate outer member made from layers of substantially flat paper laminated and shaped into a desired shape, said outer member extending axially along the side of the tubular corner post away from the product; and a separate elongate inner member made from layers of substantially flat paper laminated and shaped into a desired shape, said inner member extending axially along the side of the tubular corner post toward the product, said inner member being substantially coextensive with and spaced from the outer member to define at least one hollow space therebetween;

wherein the outer and inner members are joined together along the opposite edges of the corner post but not along the top and bottom ends and wherein the outer member and the inner member comprise a different number of paper layers.

7. An elongate tubular corner post for use in the packaging of a product, said corner post having a generally L-shaped cross-section, a top end, a bottom end, and opposite edges extending axially from the top end to the bottom end, said corner post comprising:

an elongate outer member made from layers of substantially flat paper laminated and shaped into a desired shape, said outer member extending axially along the side of the tubular corner post away from the product; and a separate elongate inner member made from layers of substantially flat paper laminated and shaped into a desired shape, said inner member extending axially along the side of the tubular corner post toward the product, said inner member being substantially coextensive with and spaced from the outer member to define at least one hollow space therebetween;

wherein the outer and inner members are joined together along the opposite edges of the corner post but not along the top and bottom ends and wherein the outer member and the inner member comprise different types of paper.

8. An elongate tubular corner post for use in the packaging of a product, said corner post having a generally L-shaped cross-section, a top end, a bottom end, and opposite edges extending axially from the top end to the bottom end, said corner post comprising:

an elongate outer member made from layers of substantially flat paper laminated and shaped into a desired shape, said outer member extending axially along the side of the tubular corner post away from the product; and a separate elongate inner member made from layers of substantially flat paper and shaped into a desired shape, said inner member extending axially along the side of the tubular corner post toward the product, said inner member being substantially coextensive with and spaced from the outer member to define at least one hollow space therebetween;

wherein the outer and inner members are joined together along the opposite edges of the corner post but not along the top and bottom ends and wherein the paper layers of one member are oriented in a different direction than the paper layers of the other member.

9. An elongate tubular corner post for use in the packaging of a product, said corner post having a generally L-shaped cross-section, a top end, a bottom end, and opposite edges extending axially from the top end to the bottom end, said corner post comprising:

an elongate outer member made from layers of substantially flat paper laminated and shaped into a desired shape, said outer member extending axially along the side of the tubular corner post away from the product, said outer member having a vertex and opposite vertical ends; and a separate elongate inner member made from layers of substantially flat paper laminated and shaped into a desired shape, said inner member extending axially along the side of the tubular corner post toward the product, said inner member being substantially coextensive with and spaced from the outer member to define at least one hollow space therebetween, said inner member having opposite vertical ends, each inner member vertical end having an outer edge, each inner member vertical end being turned toward the outer member at approximately a right angle and extending the distance between the outer and inner members such that the inner member is contiguous with the outer member, then turned away from the outer member vertex at approximately a right angle;

wherein each of the outer member ends is turned inwardly at approximately a right angle to the outer member to form a vertically oriented rib having an inside surface defining a corner, and wherein each end of the inner member fits within the corner defined by the inner surface of the corresponding rib of the outer member and wherein the outer edge of each end of the inner member abuts the inside surface of the corresponding rib of the outer member to form a stable corner post.

10. The corner post of claim 9 wherein the corresponding outer member and inner member ends are bonded together.

11. A generally L-shaped corner post for use in the packaging of a product, said corner post having opposite edges and comprising:

an elongate outer member made from layers of paper laminated with adhesive and located on the side of the corner post away from the product; and an elongate inner member made from layers of paper laminated with an adhesive different than the adhesive used to laminate the outer member layers, said inner member being substantially coextensive with the outer member and located on the side of the corner post toward the product;

wherein the outer and inner members are joined together along the opposite edges of the corner post.

12. A generally L-shaped corner post for use in the packaging of a product, said corner post having opposite edges and comprising:

an elongate outer member located on the side of the corner post away from the product and having a vertex; and an elongate inner member substantially coextensive with the outer member and located on the side of the corner post toward the product;

wherein the outer member has opposite ends each of which is turned inwardly at approximately a right angle and then turned inwardly again at approximately a right angle to form a substantially U-shaped end defining a vertically oriented slot therein, and the inner member has corresponding ends which are straight, extend away from the vertex, and fit snugly inside the slots.

* * * * *